US006473991B2

(12) United States Patent
Poloni et al.

(10) Patent No.: US 6,473,991 B2
(45) Date of Patent: Nov. 5, 2002

(54) APPARATUS TO TRANSPORT AND COOL ROLLED PRODUCTS SUCH AS RODS, WIRES, ROUND PIECES OR SIMILAR

(75) Inventors: Alfredo Poloni, Fogliano di Redipuglia; Ferruccio Tomat, Udine; Fabio Vecchiet, Villa Vicentina; Nuredin Kapaj, Udine, all of (IT)

(73) Assignee: Danieli & C. Officine Meccaniche SpA, Buttrio (IT)

( * ) Notice: Subject to any disclaimer, the term of this patent is extended or adjusted under 35 U.S.C. 154(b) by 0 days.

(21) Appl. No.: 09/796,696

(22) Filed: Mar. 2, 2001

(65) Prior Publication Data

US 2001/0022037 A1 Sep. 20, 2001

(30) Foreign Application Priority Data

Mar. 7, 2000 (IT) ..... UD00A0047

(51) Int. Cl.[7] ..... F26B 25/00

(52) U.S. Cl. ..... 34/236; 34/107; 34/240; 34/241; 266/106; 148/601; 198/780; 198/784

(58) Field of Search ..... 34/62, 105, 107, 34/218, 225, 235, 236, 240, 241; 266/102, 106; 242/361, 361.2; 198/780, 784, 35 R, 37, 952; 148/600, 601, 595; 72/13.8, 201

(56) References Cited

U.S. PATENT DOCUMENTS

| | | | | |
|---|---|---|---|---|
| 3,390,871 A | | 7/1968 | McLean et al. | |
| 3,832,788 A | * | 9/1974 | Kato et al. | 34/394 |
| 3,940,967 A | * | 3/1976 | Vitelli | 72/201 |
| 4,054,276 A | * | 10/1977 | Wilson | 266/106 |
| 4,084,797 A | * | 4/1978 | Karlberger | 266/106 |
| 4,468,262 A | * | 8/1984 | Kaneda et al. | 148/600 |
| 4,580,353 A | * | 4/1986 | Jalil et al. | 148/595 |
| 4,843,734 A | | 7/1989 | Varwig | |
| 5,079,937 A | * | 1/1992 | Scholer | 72/13.8 |
| 5,871,596 A | * | 2/1999 | Kiefer | 148/601 |

FOREIGN PATENT DOCUMENTS

| | | |
|---|---|---|
| DD | 77182 | 10/1970 |
| EP | 0060227 | 9/1982 |
| JP | 59113918 | 6/1984 |

* cited by examiner

*Primary Examiner*—Ira S. Lazarus
*Assistant Examiner*—Kathryn S. O'Malley
(74) *Attorney, Agent, or Firm*—Stevens, Davis, Miller, & Mosher, LLP

(57) ABSTRACT

Apparatus to transport and cool rolled products such as bars, round pieces, rods or similar, arrangable downstream of a coil-forming head, comprising a plurality of transport rollers, at least partly motorized and parallel to each other to define a substantially horizontal transport plane on which the rolled products arranged in coils are able to lie, ventilator in correspondence with the transport rollers to blow air towards the rolled products and a conveyor to convey more air towards the lateral edges of the coils than towards the central zone of the coils, the conveyor comprising a plurality of elements, arranged at intervals between the transport rollers. Each of the elements shaped to define transit channels having a first transverse section greater in correspondence with the ends of the transport rollers and a second transverse section less in correspondence with the median zone of the transport rollers.

26 Claims, 4 Drawing Sheets

APPARATUS TO TRANSPORT AND COOL ROLLED PRODUCTS SUCH AS RODS, WIRES, ROUND PIECES OR SIMILAR

FIELD OF THE INVENTION

This invention concerns an apparatus to transport and cool rod, metal wires, steel round pieces or similar, in the segment between a coil-forming machine, arranged downstream of the last rolling stand of a rolling mill, and a collection device where the cooled product is wound into rolls or coils.

BACKGROUND OF THE INVENTION

In the field of hot rolling mills, the state of the art includes apparatus to convey and simultaneously cool rolled product, such as rods, wires, bars, round pieces or similar, between the outlet of the last rolling stand and the collection device. The rolled product, in fact, which at outlet from the last rolling stand has a temperature of between 750° C. and 1150° C., before being wound into rolls or coils is properly cooled, and possibly subjected to heat treatment, to give it the desired final structure and the desired mechanical properties.

This cooling is usually achieved by using air, which is blown onto the product passing through by blowers arranged below a horizontal conveyor with rollers.

The rolled product, downstream from the last rolling stand, passes into a coil-forming head.

Since the density of the coils is higher in the lateral zone of the conveyor than in the central zone, it is necessary to provide means which provide a substantially uniform cooling of the product.

The state of the art includes an apparatus wherein, between the blowers which blow the air and the conveyor rollers there are one or more horizontal plates with differentiated apertures, consisting of slits or holes, to direct a greater quantity of air in correspondence with the lateral zones of the conveyor.

This conventional apparatus has the disadvantage, however, that it is very bulky, complex and therefore costly, and it is not versatile, because once the holed plates have been sized, and located between the blowers and the rollers, they are difficult to modify or replace with others having a different configuration of the apertures. This disadvantage is not insignificant, if we think that it is essential to adapt the cooling methods according to the type of product treated and the final result to be obtained. It must not be forgotten that the cooling curve of the product, that is, the progressive lowering of the temperature, univocally causes the phase transformation, and consequently the final mechanical characteristics of the product.

Document JP-A-59-113918 discloses a device to transport and cool rolled bars wound in coils, which comprises a plurality of conveyor rolls arranged with the axes of rotation parallel to each other. Each conveyor roll has a cylindrical central part, which has a set diameter and is able to contact the rolled stock to be conveyed, and two lateral parts with a smaller diameter than that of the central part. Between the rolls, brought into reciprocal proximity, passages are created for the cooling air, which is blown from below. The passages are narrower at the center and wider in correspondence with the lateral zones. The device has at least the following two disadvantages, however: the lateral ends of the conveyor rolls are weakened, since their diameter is reduced with respect to that of the central part; moreover, in correspondence with the lateral ends the coils tend to deform, because they have nothing to support them.

The present Applicant has devised, embodied and tested, with excellent results, the apparatus to transport and cool rolled products such as rods, wires, round pieces or similar according to the invention, to overcome these shortcomings of the state of the art.

SUMMARY OF THE INVENTION

The apparatus to transport and cool rolled products according to the invention is set forth and characterized in the main claim, while the dependent claims describe other innovative features of the invention.

The apparatus according to the invention, which is able to be arranged downstream of a coil-forming head in a rolling mill, comprises transport rollers, at least some of which are motorized, arranged parallel so as to define a substantially horizontal transport plane on which the rolled product arranged in coils is able to lie, ventilation means being arranged in correspondence with the transport rollers to blow air towards the rolled product and conveyor means to convey a greater quantity of air towards the lateral edges of the coils than that conveyed towards the central zone of the coils.

One purpose of the invention is to achieve means to convey the air which allow to cool the rolled product homogeneously while it is being transported by the transport rollers and which are at the same time simple, reliable and easy to replace.

In accordance with this purpose, the means to convey the air comprise a plurality of elements arranged at intervals between the transport rollers and shaped so as to define transit channels, or outflow gaps, having at least a first transverse section which is greater in correspondence with the ends of the transport rollers and at least a second transverse section which is less in correspondence with the median zone of the transport rollers.

The intermediate elements preferably consist of rollers arranged slightly lower than the drawing rollers, so that they do not interfere with the rolled product above, so they are so-called "dummy rollers".

While the general concept applies that the diameter of the intermediate rollers is variable, the shape of the latter can be chosen as desired, according to the characteristics of the product to be cooled, the density of the coils, the speed of transport of the product and any other parameter which might influence the cooling curve.

According to another characteristic feature, which adds to and integrates the advantages of the intermediate elements, in the median zone of the conveyor conduit of the ventilation means two switches are provided; the controlled inclination thereof allows to direct more or less air towards the ends of both the drawing and the intermediate rollers.

BRIEF DESCRIPTION OF THE DRAWINGS

These and other characteristics of the invention will be clear from the following description of some preferential forms of embodiment, given as a non-restrictive example, with reference to the attached drawings wherein.

DETAILED DESCRIPTION OF PREFERRED EMBODIMENTS

Figure 1:
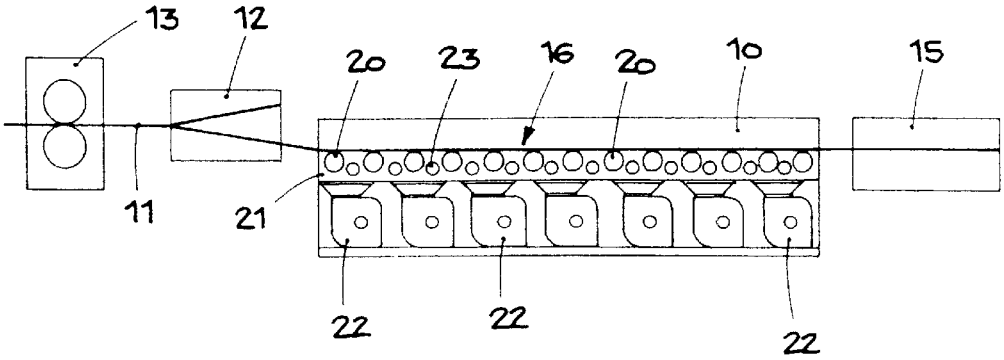
FIG. 1 is a schematic side view of a transport and cooling apparatus according to the invention.

With reference to FIG. 1, an apparatus 10 to transport and cool rolled products 11, such as wires, round pieces, rods or similar, according to the invention, is arranged between a coil-forming head 12, which is downstream of the last rolling stand 13, and a collection device 15 of a conventional type.

Figure 2:
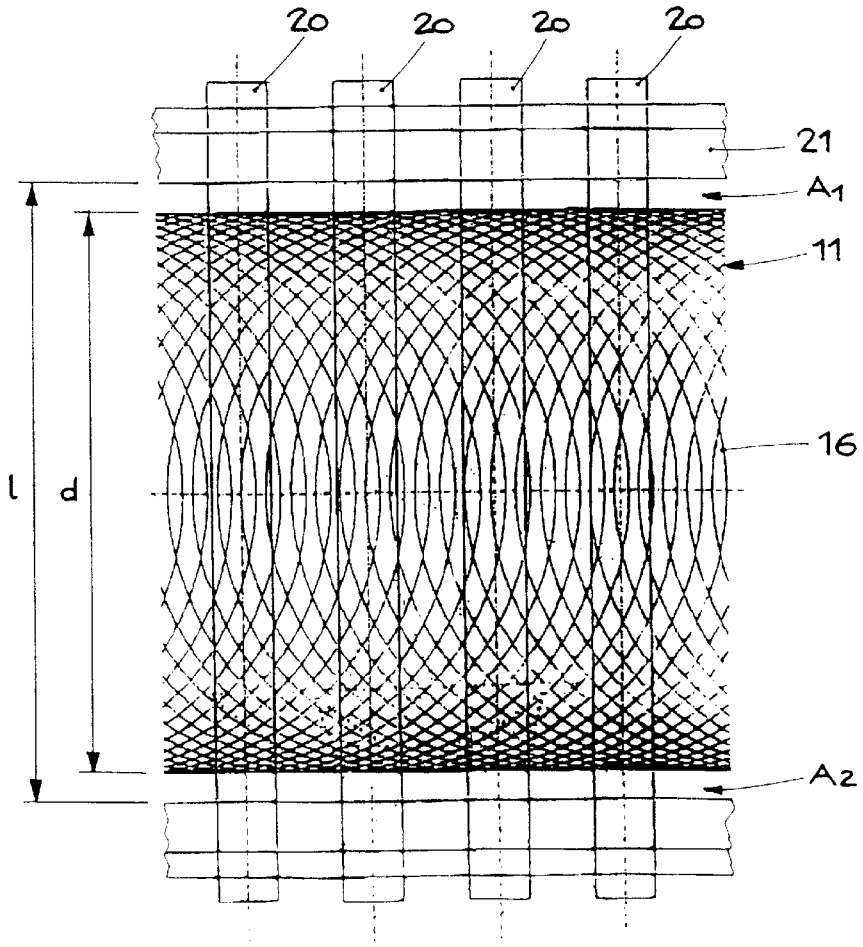
FIG. 2 is a view from above, partial and enlarged, of the apparatus in FIG. 1.

The coil-forming head 12 is able to bend the rolled product 11, emerging from the rolling stand 13 at a temperature of between about 750° C. and 1150°, to form a plurality of coils 16 (FIGS. 1 and 2), continuous and substantially circular in shape, which are able to arrange themselves on a substantially horizontal plane, each one slightly off-set with respect to the adjacent coil.

The apparatus 10 comprises a plurality of transport rollers 20 mounted rotatable on a supporting structure 21 and arranged parallel to each other so as to define a substantially horizontal supporting plane, or transport belt, for the coils 16. The transport belt has a width "l" (FIG. 2) a little more than the diameter "d" of the coils 16 and defines two lateral areas $A_1$ and $A_2$ between the coils 16 and the lateral sides of the structure 21.

The zones $A_1$ and $A_2$ serve to prevent the coils 16 from jamming on the sides of the structure 21.

At least some of the transport rollers 20 are motorized by motors and transmission organs of a conventional type, not shown in the drawings.

Figure 3:
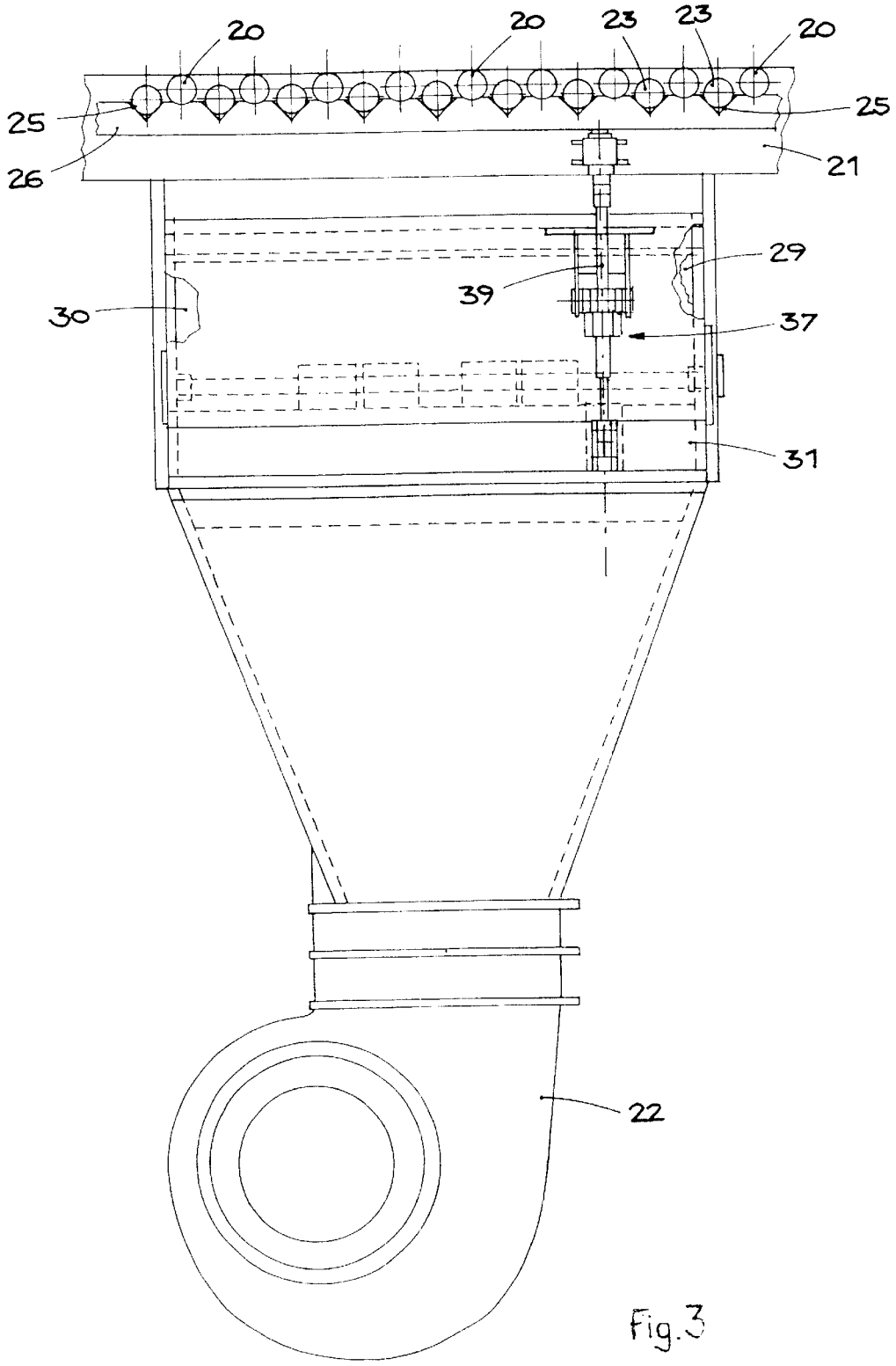
FIG. 3 is an enlarged detail of FIG. 1.

Under the transport rollers 20 a plurality of blowers 22 are arranged (FIGS. 1 and 3), each of which is able to generate a flow of air, from the bottom upwards, able to hit the coils 16 passing on the transport rollers 20 above.

According to one characteristic of the invention, intermediate rollers 23 are arranged at intervals between the transport rollers 20. The rollers 23 rest in a removable manner on corresponding V-shaped seatings 25 made on bars 26 which support the structure 21.

The intermediate rollers 23 are arranged on a lower plane than the transport rollers 20, so that they never come into contact with the product 11 which has to be transported and cooled.

The intermediate rollers 23 are shaped so as to define, together with the transport rollers 20, transit channels or outflow gaps 27 (FIGS. 5*a*–5*d*) for the air arriving from the blowers 22. To be more exact, the transverse section of the channels 27 is greater in correspondence with the ends of the transport rollers 20 and less in correspondence with the median zone of the latter. This is to convey a greater quantity of cooling air towards the lateral ends of the coils 16, where there is a greater density, and to provide a substantially homogeneous cooling of the rolled product 11.

Figure 5A:
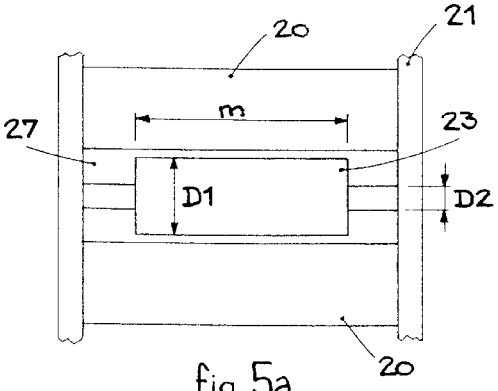
FIGS. 5*a*–5*d* are schematic representations of a detail of the apparatus shown in FIG. 1, according to four forms of embodiment.
Figure 5B:
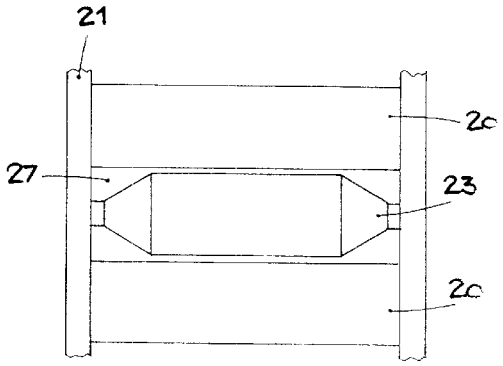
Figure 5C:
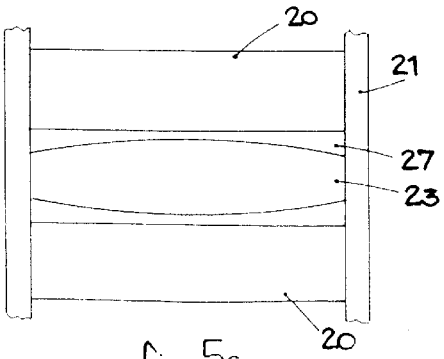
Figure 5D:
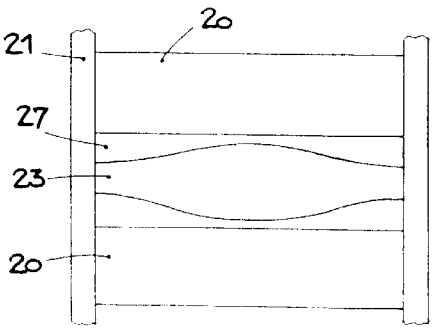

To obtain this variation in section in the channels 27, the intermediate rollers 23 can have any convenient shape; they may have a constant diameter D1 in the median zone and a diameter D2, less than D1, in the peripheral zones, with a sudden change in diameter between the two zones (FIG. 5*a*); a shape identical to the previous one but with a gradual connection zone between the median zone and the peripheral zone (FIG. 5*b*); a barrel-type shape (FIG. 5*c*); or a sinusoidal shape (FIG. 5*d*). Obviously, the rollers 23 may have many other shapes, not shown here.

According to a variant, in order to optimize the feeding of air towards the zones where the coils 16 are most dense, and at the same time to prevent a large quantity of air from being conveyed to no purpose towards the zones $A_1$ and $A_2$ of the transport belt, the intermediate rollers 23 are appropriately shaped so that their ends 23*a* and 23*b* (FIGS. 7*a*–7*d*), near the structure 21, have the same diameter D1 which they have in their central zone. Advantageously the distance between the inner edges of the two ends 23*a* and 23*b* is the same as the diameter "d" of the coils 16.

Advantageously the ratio between the diameter D2 and the diameter D1 is between 0.1 and 0.7.

Figure 7A:
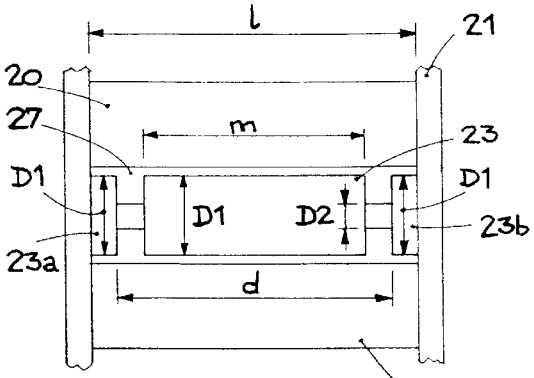
FIGS. 7*a*–7*d* show the four embodiments of FIGS. 5*a*–5*d* in a variant.
Figure 7B:
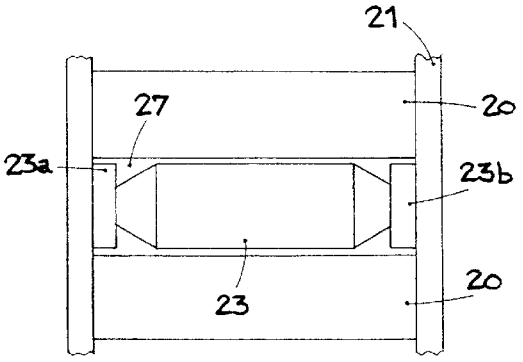
Figure 7C:
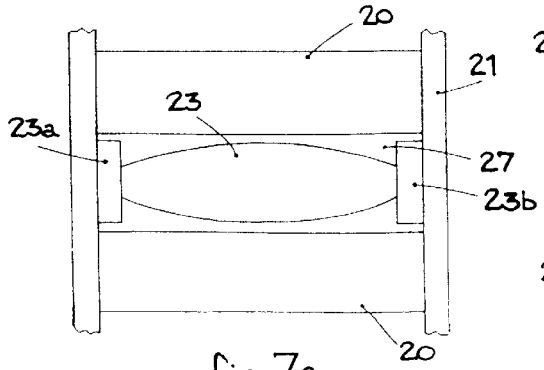
Figure 7D:
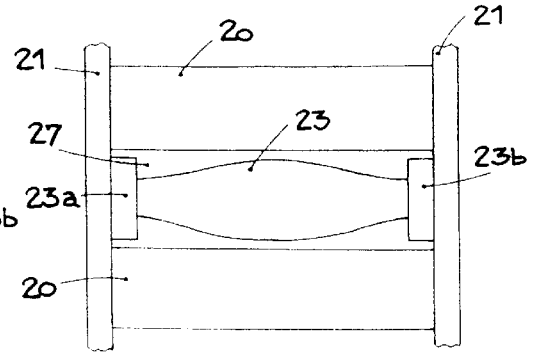

Moreover, the ratio between the length of the median zone "m" (FIGS. 5*a* and 7*a*) and the diameter "d" of the coils 16, which in FIG. 7*a* corresponds substantially to the distance between the inner edges of the two ends 23*a* and 23*b*, is advantageously between 0.5 and 0.9.

Each intermediate roller 23, since it is resting on the corresponding V-shaped seatings 25, can easily be removed and replaced, even by another roller of a different shape, so as to vary the section of the channels 27.

Moreover, the intermediate rollers 23 can also be regulated in height, by means of any conventional device, not shown in the drawings, in order to adapt the apparatus 10 to the different conditions and materials rolled, without having to change the rollers 23 themselves.

According to a variant, not shown in the drawings, between two adjacent transport rollers 20 two or more intermediate rollers 23 may be arranged, so as to define channels 27 of different shapes.

Figure 4:
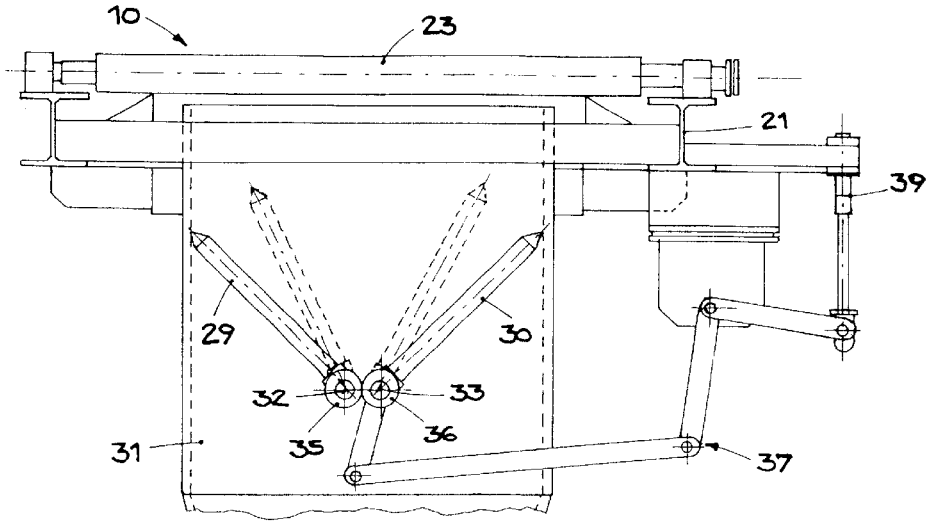
FIG. 4 is a transverse view, partial and schematic, of the apparatus shown in FIG. 1.

According to another characteristic feature of the invention, two switches 29 and 30 are associated with each blower 22 (FIGS. 3 and 4), and are arranged inside the conduit 31 to convey the air. The switches 29 and 30 are pinned on corresponding horizontal pins 32 and 33 and are connected by means of a pair of gears 35 and 36, so that their rotations, both in a clock-wise and anti-clockwise direction, are synchronized. Each switch 30 is connected to an actuation mechanism 37, comprising a fluido-dynamic piston 39, which is able to regulate the simultaneous inclination of both switches 29 and 30.

With each mechanism 37 it is thus possible to regulate the diversion, towards the ends of the rollers 20 and 23, of the quantity of air which is thrust upwards by the corresponding blower 22.

Figure 6:
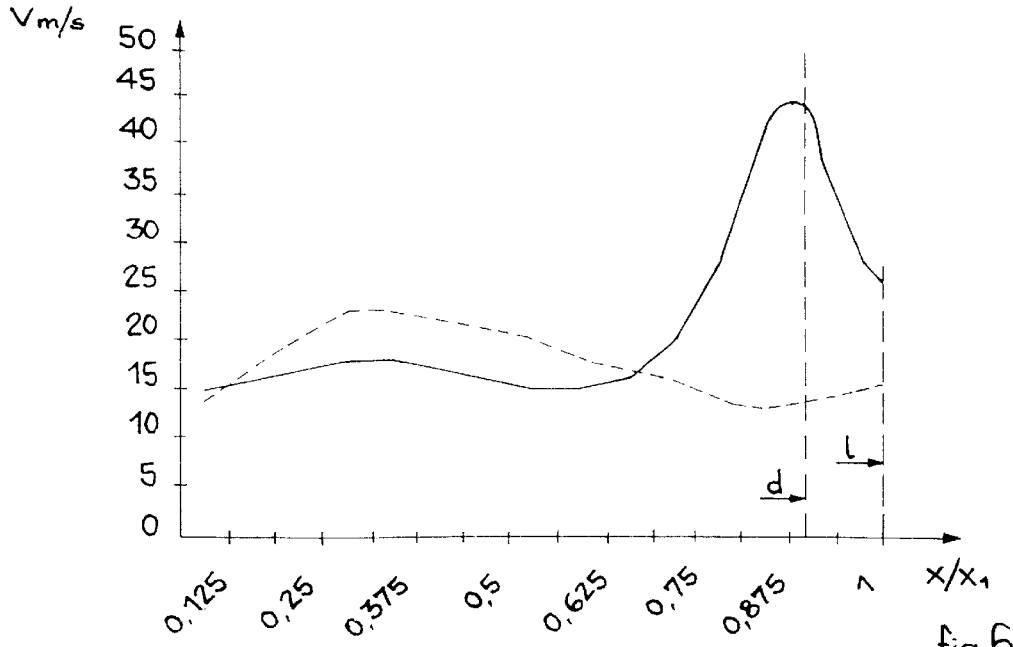
FIG. 6 is a graphic representation of the average speed of the air in the different zones of the apparatus shown in FIG. 1, compared with that of conventional apparatuses.

Practical tests have proved that with the apparatus 10 according to the invention, the average speed of the air in the different zones of the transport belt, from the centre towards the periphery of the rollers 20, or towards the sides of the supporting structure 21, has a development represented by a continuous line in the graph shown in FIG. 6, wherein the x-axis indicates the ratio between the value "X" measured from the center of the transport belt and the distance "$X_1$" from the center of the transport belt to the periphery of the latter. As can be seen, the development of the average air speed, expressed in meters per second, has a peak precisely in correspondence with the zone where the coils 16 of the rolled product 11 have their greatest density, contrary to what happens in conventional devices, where the average air speed, in the corresponding zones of the transport belt, is substantially constant, as is clear from the line of dashes shown in FIG. 6.

In fact, in the apparatus 10 according to the invention, it is the outflow area between the drawing roller 20 and the intermediate roller 23 which distributes the air between the edge and center of the transport belt. The shape of the intermediate roller 23 serves to manage the speed profile on the width "l" of the belt, even if the air speed ratio at the edge and center is the same.

It is obvious that modifications and additions may be made to the apparatus 10 as described heretofore, but these shall remain within the field and scope of the invention. For example, the intermediate rollers 23 could be replaced by elements having a non-cylindrical shape, such as plates with a variable section or otherwise.

It is also obvious that, although the invention has been described with reference to a specific example, a skilled person shall certainly be able to achieve many other equivalent forms thereof, but these shall all come within the field and scope of the invention.

What is claimed is:

1. Apparatus to transport and cool rolled products (11) able to be arranged downstream of a coil-forming head (12), comprising:

a plurality of transport rollers (20), at least partly motorized and arranged parallel to each other so as to define a substantially horizontal transport plane on which said rolled products (11) arranged in coils (16) are able to lie, ventilation means (22) arranged in correspondence with said transport rollers (20) to blow air towards said rolled products (11) and conveyor means to convey towards the lateral edges of said coils (16) a greater quantity of air than that conveyed towards the central zone of said coils (16), wherein said conveyor means comprise a plurality of elements (23) arranged at intervals between said transport rollers (20), each of said elements (23) being shaped so as to define transit channels (27) and the quantity of air permitted to pass to pass though said transit chanels (27), said transit channels (27) having at least a first transverse section which is greater in correspondence with the ends of said transport rollers (20) and at least a second transverse section which is less in correspondence with the median zone of said transport rollers (20).

2. Apparatus as in claim 1, wherein said elements consist of variable section plates.

3. Apparatus as in claim 1, wherein said ventilation means comprise a plurality of blowers (22), wherein with each of said blowers (22) is associated at least a switch (30) arranged inside an air conveyor conduit (31), located between the corresponding blower (22) and said transport rollers (20) and able to divert the air blown by the blower (22) towards said first greater transverse section.

4. Apparatus as in claim 3, wherein said switch (30) is connected with an actuation mechanism (37) able to regulate the inclination thereof.

5. Apparatus as in claim 4, wherein two switches (29, 30) are associated with each of said blowers (22).

6. Apparatus as in claim 3, wherein two switches (29, 30) are associated with each of said blowers (22).

7. Apparatus as in claim 3, wherein two switches (29, 30) are associated with each of said blowers (22).

8. Apparatus as in claim 3, wherein the cooled rolled products are selected from the group consisting of bars, round pieces and rods.

9. Apparatus of claim 1, wherein said intermediate rollers (23) are arranged on a lower plane than said transport rollers (20), such that said intermediate rollers (23) do not contact said products (11).

10. Apparatus as in claim 1, wherein said elements comprise variable section plates.

11. Apparatus of claim 1, wherein said transit channels (27) are not all of the same shape.

12. Apparatus to transport and cool rolled products (11) able to be arranged downstream of a coil-forming head (12), comprising:

a plurality of transport rollers (20), at least partly motorized and arranged parallel to each other so as to define a substantially horizontal transport plane on which said rolled products (11) arranged in coils (16) are able to lie, ventilation means (22) arranged in correspondence with said transport rollers (20) to blow air towards said rolled products (11) and conveyor means to convey towards the lateral edges of said coils (16) a greater quantity of air than that conveyed towards the central zone of said coils (16), wherein said conveyor means comprise a plurality of elements (23) arranged at intervals between said transport rollers (20), each of said elements (23) being shaped so as to define transit channels (27) having at least a first transverse section which is greater in correspondence with the ends of said transport rollers (20) and at least a second transverse section which is less in correspondence with the median zone of said transport rollers (20) and said elements consist of intermediate rollers (23) with a variable diameter.

13. Apparatus as in claim 12, wherein said intermediate rollers (23) have a greater diameter (D1) in correspondence with a lower median zone and a smaller diameter (D2) in correspondence with their ends.

14. Apparatus as in claim 13, wherein said intermediate rollers (23) are barrel-shaped.

15. Apparatus as in claim 13, wherein said intermediate rollers (23) are sinusoidal in shape.

16. Apparatus of claim 13, wherein a ratio between said median zone, corresponding substantially to the width of said intermediate rollers (23), and the diameter of said coils (16) is between 0.5 and 0.9.

17. Apparatus of claim 13, wherein a ratio between said smaller diameter (D2) and said greater diameter (D1) is between 0.1 and 0.7.

18. Apparatus as in claim 2, wherein said intermediate rollers (23) have their ends resting in a removable fashion on V-shaped seatings (25) made on a supporting structure (21).

19. Apparatus as in claim 12, wherein said intermediate rollers (23) are associated with lifting means able to regulate their position in height with respect to said transport rollers (20).

20. Apparatus as in claim 12, wherein said intermediate rollers (23) are shaped so that their ends **(23*a*, 23*b*), outside the bulk of said coils (16)**, have substantially the same diameter (D1) as said median zone.

21. Apparatus as in claim 12, wherein two or more intermediate rollers (23) are arranged between two adjacent transport rollers (20).

22. Apparatus of claim 12, wherein said intermediate rollers (23) are arranged on a lower plane than said transport rollers (20), such that said elements (23) do not contact said products (11).

23. Apparatus of claim 12, wherein said transit channels (27) are not all of the same shape.

24. Apparatus to transport and cool rolled products (11) able to be arranged downstream of a coil-forming head (12), comprising:

a plurality of transport rollers (20), at least partly motorized and arranged parallel to each other so as to define a substantially horizontal transport plane on which said rolled products (11) arranged in coils (16) are able to lie, ventilation means (22) arranged in correspondence with said transport rollers (20) to blow air towards said rolled products (11) and conveyor means to convey towards the lateral edges of said coils (16) a greater quantity of air than that conveyed towards the central zone of said coils (16), wherein said conveyor means comprise a plurality of elements (23) arranged at intervals between said transport rollers (20), each of said elements (23) being shaped so as to define transit channels (27) having at least a first transverse section which is greater in correspondence with the ends of said transport rollers (20) and at least a second transverse section which is less in correspondence with the median zone of said transport rollers (20), wherein said ventilation means comprise a plurality of blowers (22), wherein with each of said blowers (22) is associated at least a switch (30) arranged inside an air conveyor conduit (31), located between the corresponding blower (22) and said transport rollers (20) and able to divert the air blown by the blower (22) towards said first greater transverse section, wherein two switches (29, 30) are associated with each of said blowers (22), and wherein said two switches (29, 30) are connected with each other by means of a pair of gears (35, 36) so that their inclinations are synchronized.

25. Apparatus of claim 24, wherein said intermediate rollers (23) are arranged on a lower plane than said transport rollers (20), such that said intermediate rollers (23) do not contact said products (11).

26. Apparatus of claim 24, wherein said transit channels (27) are not all of the same shape.

* * * * *